US007677263B2

(12) United States Patent
Hoji et al.

(10) Patent No.: US 7,677,263 B2
(45) Date of Patent: Mar. 16, 2010

(54) TANDEM PUMP VALVE STRUCTURE

(75) Inventors: Takeshi Hoji, Tokyo (JP); Satoshi Nagao, Tokyo (JP); Keisuke Shinozaki, Tokyo (JP)

(73) Assignee: TBK Co., Ltd., Tokyo (JP)

( * ) Notice: Subject to any disclaimer, the term of this patent is extended or adjusted under 35 U.S.C. 154(b) by 518 days.

(21) Appl. No.: 11/612,015

(22) Filed: Dec. 18, 2006

(65) Prior Publication Data

US 2008/0041472 A1 Feb. 21, 2008

(30) Foreign Application Priority Data

Aug. 15, 2006 (JP) ..... 2006-221582

(51) Int. Cl.
*G05D 11/00* (2006.01)

(52) U.S. Cl. ..... 137/115.26; 137/102; 137/112; 417/286; 417/307

(58) Field of Classification Search ..... 137/102, 137/115.26, 110, 112; 417/286, 287, 302–304, 417/307, 310, 427, 428
See application file for complete search history.

(56) References Cited

U.S. PATENT DOCUMENTS

| | | | | |
|---|---|---|---|---|
| 1,966,814 | A * | 7/1934 | Ferris | 417/428 |
| 2,624,283 | A * | 1/1953 | Hirvonen | 417/287 |
| 2,669,256 | A * | 2/1954 | Rampton | 137/499 |
| 2,878,753 | A * | 3/1959 | Adams et al. | 417/287 |
| 2,887,060 | A * | 5/1959 | Adams et al. | 417/287 |
| 2,977,888 | A * | 4/1961 | Livermore | 417/310 |
| 3,000,396 | A * | 9/1961 | Davis | 137/516.15 |
| 3,692,432 | A * | 9/1972 | Liang et al. | 417/286 |
| 3,873,241 | A * | 3/1975 | Motomura | 417/286 |
| 4,502,845 | A * | 3/1985 | Chana | 417/428 |
| 5,087,177 | A * | 2/1992 | Haley et al. | 417/426 |
| 5,338,161 | A * | 8/1994 | Eley | 417/307 |
| 5,797,732 | A * | 8/1998 | Watanabe et al. | 417/310 |

FOREIGN PATENT DOCUMENTS

WO 2006/033207 3/2006

OTHER PUBLICATIONS

U.S. Appl. No. 11/612,044 to Hoji et al., filed Dec. 18, 2006.

* cited by examiner

*Primary Examiner*—John Rivell
*Assistant Examiner*—Craig Price
(74) *Attorney, Agent, or Firm*—Greenblum & Bernstein P.L.C.

(57) ABSTRACT

When the pressure in a main fluid supply channel is lower than a no-load operation start pressure, the spool moves against the biasing force of a biasing member, and the area of opening of a auxiliary fluid supply channel is reduced with regards to opening of the internal flow channel. When the pressure in the main fluid supply channel rises and reaches a no-load operation start pressure, the area of opening in the auxiliary fluid supply channel with regards to opening of the internal flow channel becomes smaller and while connected to the main fluid supply channel, the auxiliary fluid supply channel is connected to the return flow channel. When the pressure in the main fluid supply channel rises above the no-load operating start pressure and reaches a no-load operation pressure, the auxiliary fluid supply channel is cut off from the main fluid supply channel.

4 Claims, 6 Drawing Sheets

TANDEM PUMP VALVE STRUCTURE

TECHNICAL FIELD

The present invention relates to a valve structure for a tandem pump having two fluid pumps simultaneously driven by a drive source and having a structure where pressurized oil discharged from both fluid pumps is merged together and supplied to the fluid supply subject.

BACKGROUND OF THE INVENTION

A tandem pump can discharge the same or different pressurized fluids from the discharge ports of both fluid pumps, or can supply the flow of two pumps using a structure that merges the fluids discharged from both fluid pumps, and this flow is supplied to a single fluid supply subject. A known example of this type of tandem pump is an oil pump which supplies oil for lubricating and cooling the oil gallery in an engine case. With this oil pump, even if the engine which is the drive source has low output and the pump rotational speed is low, the oil discharged from both pumps can be merged together in order to provide sufficient oil flow for lubrication. Furthermore, when the pump rotational speed is high, excessive oil supply can be prevented by running one of the fluid pumps in a no-load condition and supplying the oil from the second fluid pump to the oil gallery, in order to prevent wasting engine power.

In order to efficiently operate the pump based on the pump rotational speed, a tandem pump generally has a no-load valve to put one fluid pump in a no-load condition. When the structure is such that the oil discharged from both fluid pumps is guided such that the fluid supply channels merge, a check valve is provided to prevent oil discharged from the second pump from flowing back from the merge point when the first fluid pump is in a no-load condition. Note, during high speed operation of the pump, only the oil discharged from the second pump is supplied to the oil gallery, but a relief valve is provided to protect the oil pressure system and is set to keep the pressure of oil discharged from that fluid pump below a prescribed pressure.

When a plurality of separate valves are provided, the overall size of the pump equipment will increase, and therefore a valve structure which has the functions of three valves has been proposed, with a spool and tappet provided in line along the discharge channel of one fluid pump (for instance, refer to International Patent Disclosure 06/033207). With this valve structure, the function of a plurality of valves can be achieved using fewer components and the valves for a tandem pump can be made more compact.

With the valve structure shown in International Patent Disclosure 06/033207, when the discharge of oil pressure is below a no-load operation pressure, the oil discharged from one of the oil pumps will merge with the oil discharged from a second oil pump in the internal channel of the spool and will be supplied to the oil gallery. When the discharge of oil pressure reaches the no-load operation pressure, a part which is connected to the discharge opening of one oil pump will be connected to the drain (or to the intake opening of that same pump). Furthermore, the pressure differential between the oil pressure of the oil in the internal channel discharged from the oil pump connected to the drain and the oil pressure of the oil discharged from the second oil pump which flows to the space on the right side of the spool will move the tappet to the left. Therefore, the tappet and the spool will contact, the inside channel will be closed, and all of the oil output from the first oil pump will be discharged to the drain side.

With this valve mechanism, the rate of flow discharged from the pump will be cut to approximately one half immediately after the no-load operation pressure is exceeded, the oil pressure will drop, and may fall below the no-load operating pressure. Therefore the spool and tappet will separate, the oil discharged from both oil pumps will be merged together, and the discharged oil flow will approximately double, and therefore the oil pressure will rise and again reach the no-load operating pressure, and the spool and tappet will make contact. In this manner, when the discharge oil pressure of the pump is close to the no-load operating pressure, the tappet will move back and forth in the axial direction and will repeatedly contact and separate from the spool (chattering), and there is a possibility of causing noise. Furthermore, movement of the tappet back-and-forth is also a cause of pulsing pressure in the supplied oil.

SUMMARY OF THE INVENTION

With the foregoing in view, it is an object of the present invention to provide a tandem pump valve structure which can help prevent this type of chattering with a simple structure.

The tandem pump valve structure of the present invention comprises a tandem pump having a main fluid pump and an auxiliary fluid pump which are simultaneously driven by a drive source, a main fluid supply channel which extends from a discharge opening of the main fluid pump to a fluid supply subject, an auxiliary fluid supply channel extending from a discharge opening of the auxiliary fluid pump and connecting to the main fluid supply channel, a spool which has an internal flow channel extending in the axial direction of the spool and which is fitted by insertion to be able to move inside a valve bore which forms a part of the auxiliary fluid supply channel, a biasing member which applies a bias to one side in the axial direction of the spool in the valve bore, and a return flow channel which is connected to the valve bore; wherein the spool receives pressure from the main fluid supply channel, is able to move in the axial direction toward a second end side of the spool, counteracting the biasing force of the biasing member; the auxiliary fluid supply channel is communicated with the main fluid supply channel through the internal flow channel when the pressure in the main fluid supply channel is lower than a no-load operation start pressure; the spool is moved against the biasing force of the biasing member and the area of opening of the auxiliary fluid supply channel is smaller with regards to the internal flow channel when the pressure in the main fluid supply channel rises; the auxiliary fluid supply channel is connected to the return flow channel, with the auxiliary fluid supply channel which has a reduced opening area with regards to the internal flow channel being communicated with the main fluid supply channel, when the pressure in the main fluid supply channel rises to the no-load operation start pressure; and the auxiliary fluid supply channel is cut off from the main fluid supply channel when the pressure in the main fluid supply channel rises above the no-load operation start pressure to reach a no-load operation pressure.

With this structure, it is also acceptable for both the auxiliary fluid supply channel and the main fluid supply channel to be connected to the return flow channel if the pressure in the main fluid supply channel reaches a relief valve set pressure which is higher than the no-load operation pressure.

Furthermore, it is also acceptable that the spool comprises a main unit having the internal flow channel, and a biasing force effector which receives a biasing force from the biasing member and which is connected to the other end of the main unit; the spool main unit comprises a first end land part, middle land part, and a second end land part, all of which are cylindrically shaped and separated in the axial direction of the spool, a first end rod part which is formed in a cylindrical shape with a smaller diameter than the middle land part and which links the first end land part and the middle land part, and a second end rod part which is formed in a cylindrical shape with a smaller diameter than the middle land part and which links the middle land part and the second end land part; the first end land part, middle land part, and second end land part are fitted in the valve bore, one end groove is formed to be encompassed by the outer circumferential surface of the first end rod part and the inner circumferential surface of the valve bore, and a second groove is formed to be encompassed by the outer circumferential surface of the second end rod part and the inner circumferential surface of the valve core.

Furthermore, it is also acceptable that a first end through-hole is formed to pass through the outer circumferential surface and communicate with the inside flow channel at the first land part, and a second end through-hole is formed to pass through the outer circumferential surface and communicate with the inside flow channel at one of either the second end rod part or the second end land part; the first end through-hole communicates the main fluid channel with the inside flow channel regardless of the travel position of the spool; and the second end through-hole is constructed such that the area of the opening to the auxiliary fluid channel changes depending on the travel position of the spool.

Furthermore, it is also acceptable that the tandem pump comprises a drive gear which is driven by a drive source, and a gear pump comprising a first driven gear and a second driven gear which externally mesh with the drive gear. Note, preferably the return flow channel is connected to an intake opening of the auxiliary fluid pump.

With the tandem pump valve structure of the present invention, the area of the opening of the auxiliary fluid supply channel to the internal flow channel become smaller as the pressure in the main fluid supply channel rises, and the auxiliary fluid supply channel is constricted in the flow channel until being connected to the main fluid supply channel, so the ratio of the discharge quantity from the auxiliary fluid pump to the total discharge quantity from the tandem pump will be gradually reduced. Therefore, even if the pressure in the main fluid supply channel increases to exceed the no-load operating start pressure, and the portion of the pressure from the discharge opening in the auxiliary fluid supply channel decreases until reaching the valve bore, the pressure in the main fluid supply channel (internal flow channel side) will not be largely affected because of this constriction. Therefore, in this condition, the possibility of the aforementioned chattering can be reduced. With this valve structure, the area of the opening of the auxiliary fluid supply channel to the internal flow channel is gradually made smaller as the pressure in the main fluid supply channel increases until reaching the no-load operation pressure, and the auxiliary fluid supply channel will be cut off from the main fluid supply channel when the no-load operating start pressure is reached. Therefore, the total quantity discharged from the tandem pump will not change dramatically when the connection between the auxiliary fluid supply channel and the main fluid supply channel is cut off and the auxiliary fluid pump is placed in a no-load operating condition, and therefore the conventionally seen changes in the supplied oil pressure will not easily occur. Therefore the possibility of chattering can be reduced under these conditions.

With a structure where the main fluid supply channel is connected to the return flow channel when the pressure in the main fluid supply channel exceeds the no-load operation pressure where only the fluid discharged from the main fluid pump is supplied to the fluid supply subject and further reaches the relief set pressure, the pressure in the main fluid supply channel is prevented from exceeding the predetermined relief set pressure, and the safety of the system on the fluid supply subject side can be ensured.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

DESCRIPTION OF THE PREFERRED EMBODIMENTS

Figure 1:
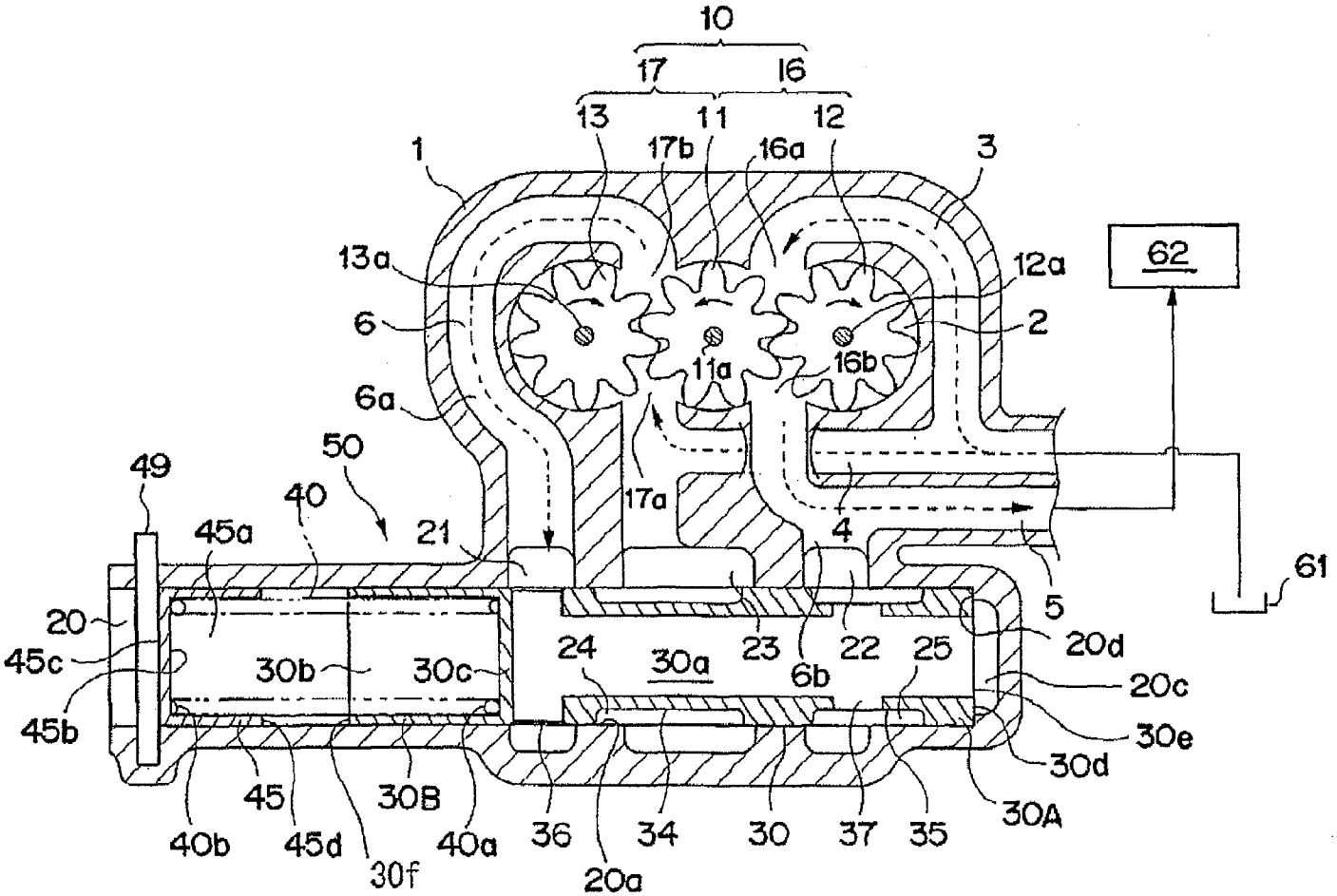
FIG. 1 is a cross-section view of a tandem pump with the tandem pump valve structure of the present invention.

The preferred embodiment of the present invention will be described below while referring to the drawings. FIG. 1 shows a tandem pump 10 constructed with a valve 50 which has the valve structure of the present invention. This tandem pump 10 is an oil pump attached to a vehicle engine, and uses the output shaft from the engine as a drive source to draw in oil for lubrication and cooling which has accumulated in a tank 61 and pump to an oil gallery 62 which is connected to various regions of the engine. The tandem pump 10 comprises a pump body 1 using a part of the engine casing, a drive gear 11 which is housed in a manner which can rotate in a pump chamber 2 formed in the pump body 1, and two driven gears (first driven gear 12 and second driven gear 13).

The drive gear 11 is supported by a drive shaft 11*a*, and the first and second driven gears 12, 13 are rotatably supported by a first and second driven shaft 12*a*, 13*a* respectively. The drive shaft 11*a* is driven by the engine crankshaft and rotates the drive gear 11 in the direction of the arrow shown in FIG. 1 (counterclockwise). The first and second driven gears 12, 13 follow the rotation of the drive gear 11 and rotate in the opposite direction to drive gear 11 (clockwise).

The drive gear 11 and the first driven gear 12 as well as the drive gear 11 and the second driven gear 13 form conventionally known gear pumps. When the drive gear 11 and the driven gears 12, 13 rotate, oil is drawn in to the pump chamber 2 from the intake opening because of the reduced pressure created when the gear teeth mutually separate because of this rotation and oil is discharged from the pump chamber 2 to the discharge opening at higher pressure by the gear teeth mutually moving together. In the embodiment shown in FIG. 1, the upper side of the engagement region between the drive gear 11 and the first driven gear 12 forms an intake opening 16*a*, while the lower side forms a discharge opening 16*b*. Furthermore, the bottom side of the engagement region between the drive gear 11 and the second driven gear 13 becomes an intake opening 17*a*, while the upper side forms a discharge opening 17*b*. Hereinafter, the gear pump comprising the drive gear 11 and the first driven gear 12 will be referred to as the main oil pump 16, and the gear pump comprising the drive gear 11 and the second driven gear 13 will be referred to as the auxiliary oil pump 17, the intake opening 16*a* and the discharge opening 17*a* of the main oil pump 16 will be referred to as the main intake opening 16*a* and the main discharge opening 17*a* respectively, and the intake opening 17*a* and the discharge opening 17*b* of the auxiliary oil pump 17 will be referred to as the auxiliary intake opening 17*a* and the auxiliary discharge opening 17*b*, respectively.

Therefore the tandem pump 10 comprises a main oil pump 16 and an auxiliary oil pump 17 which are simultaneously driven by one drive source. The pump body 1 contains a main oil intake channel 3 which is connected to the tank 61 and connected to the main intake opening 16*a*, and an auxiliary oil intake channel 4 which branches off of the main oil intake channel 3 and is connected to the auxiliary intake opening 17*a*. Furthermore, a main oil supply channel 5 is connected to the main discharge opening 16*b* and connected to the oil gallery 62, and an auxiliary oil supply channel 6 is connected to the main oil supply channel 5 inside the pump body 1 and is connected to the auxiliary discharge opening 17*b*.

The structure of a valve 50 for the tandem pump 10 with the aforementioned oil channel structure will be described while referring to FIG. 1 through FIG. 3. As will be described later, the valve 50 functions as a no-load valve and also functions as a relief valve, and is comprising a spool 30 established to slide in the valve bore 20 which is formed to be a part of the auxiliary oil supply channel 6 in the pump body 1, and a return spring 40 which biases the spool 30 to the right side within the valve for 20. Hereinafter, the section in the auxiliary oil supply channel 6 which connects the auxiliary discharge opening 17*b* and the valve bore 20 will be referred to as the upstream section 6*a* while the section which connects the valve bore 20 and the main oil supply channel 5 will be referred to as the downstream section 6*b*.

Figure 2:
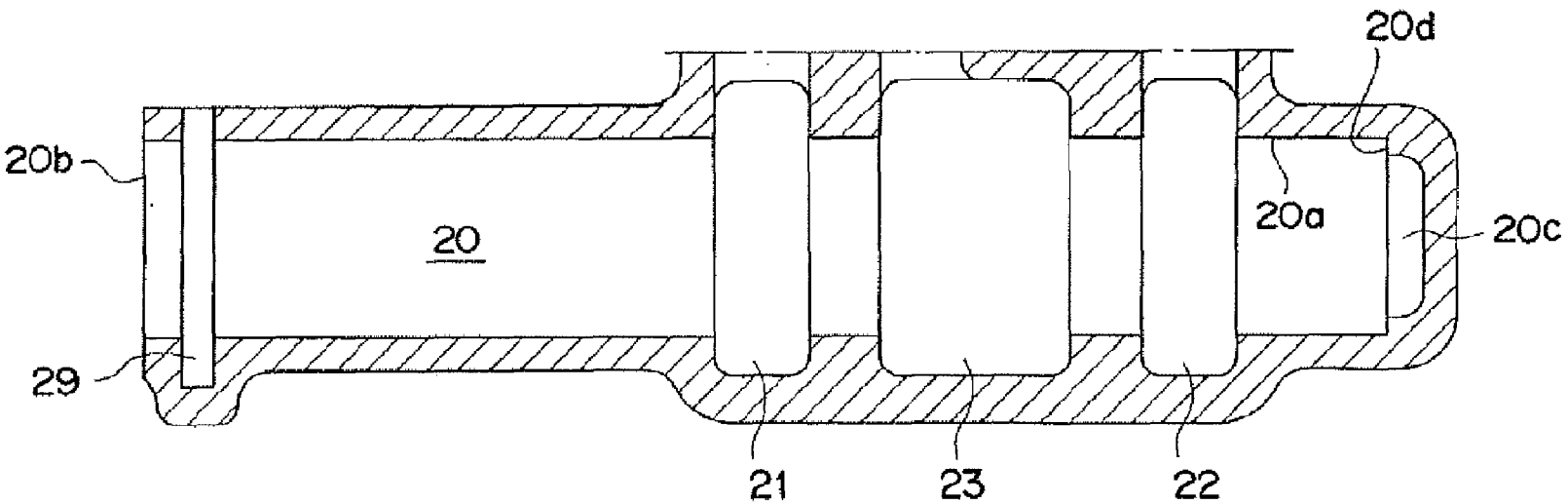
FIG. 2 is a partial cross section view of the pump body showing the valve bore.

As shown in FIG. 2, the valve bore 20 is closed on the right end, has an opening 20*b* on the left end which is connected to the outside of the pump body 1, and has a recessed region 20*c* which is formed to recess further to the right side from the center region of the right bottom surface 20*d*. The valve bore 20 has three ports 21 to 23 mutually separated in the axial direction and formed in a cylindrical shape with a diameter larger than the inner circumferential surface 20*a* of the valve bore 20. Of these ports, the first port 21, which is located on the left side, forms a part of the upstream section 6*a* of the auxiliary oil supply channel 6 and is connected to the auxiliary discharge opening 17*b*, the second port 22, which is located on the right side, forms a part of the downstream section 6*b* of the auxiliary oil supply channel 6 and is connected to the main supply channel 5, and the third port 23 which is located between the first and second ports 21, 22, is a part of the return flow channel 7 formed in the pump body 1 and is connected to the auxiliary intake opening 17*a*.

The spool 30 is integrally comprising a main unit 30A which has an internal flow channel 30*a* extending the axial direction, and a spring housing section 30B with a spring chamber 30*b* which extends in the axial direction and is connected in the axial direction to the main body 30A, and the spool 30 is inserted into the valve bore 20 through the opening 20*b* from the main unit 30A side.

With the spool 30 inserted in the valve bore 20, the return spring 40 is housed in the spring chamber 30*b* though the opening 20*b* with a portion housed in the recessed region 45*a* of the cylinder with bottom shaped retainer 45. Furthermore, the pump body 1 has a pin insertion hole 29 which passes through the left end of the valve bore 20 and extends in an axial orthogonal direction, and when the return spring 40 and the retainer 45 are inserted in the valve bore 20, a locking pin 49 is inserted into this pin insertion hole 29. Assembled in this manner, one end of the return spring 40 will contact the bottom surface 30*c* of the spring chamber 30*b*, while the other end will contact with the inside bottom surface 45*b* of the retainer 45, and the outside bottom surface 45*c* of the retainer 45 will contact the locking pin 49 and be retained inside the valve bore 20. Therefore, the return spring 40 will provide a biasing force to the right side on the bottom surface 30*c* of the spring chamber 30*b*.

The spool 30 which is biased to the right side in the valve bore 20 by the return spring 40, makes contact to the right bottom surface 20*d* of the valve bore 20 on the right end surface 30*d* of the main unit 30A, and is restricted from moving to the right. The position of the spool 30 at this time is referred to as the "initial position". On the other hand, when the spool 30 moves to the farthest left position in the valve bore 20 against the bias, the left end surface 30*f* of the spring housing section 30B will contact with the opening end surface 45*d* of the retainer 45 (refer to FIG. 6). The position of the spool 30 at this time is referred to as the "maximum left travel position".

Figure 3:
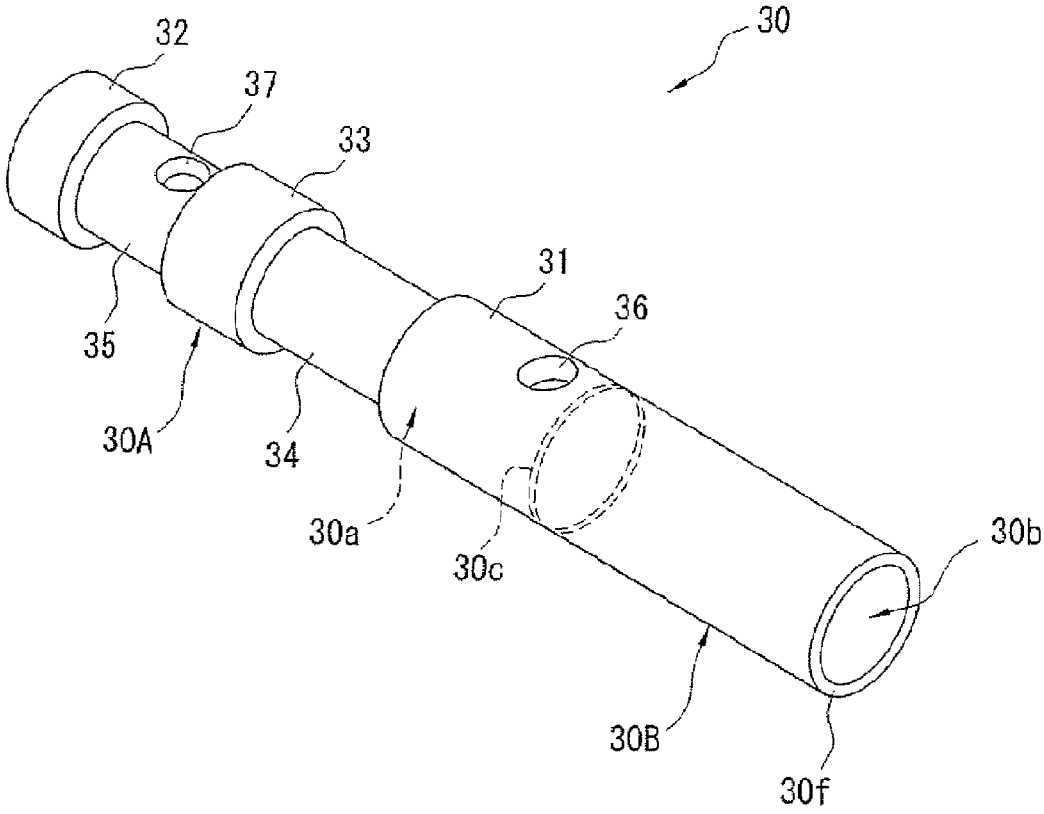
FIG. 3 is an appearance perspective view of the spool.

As shown in FIG. 3, the main unit 30A of the spool 30 is formed in a stepped cylindrical shape, and integrally has three land parts 31 to 33 which are mutually spaced apart in the axial direction and which slide along the inner circumferential surface 20*a* of the valve bore 20, and two rod parts 34, 35 which are connected between adjacent land parts and which have a cylindrical shape with a diameter smaller than the three land parts 31 to 33, and each of the land parts has a donut shaped stepped surface extending in an axial orthogonal direction which connects to the rod parts at the ends. Note, hereinafter when the spool 30 is housed in the valve bore 20, of the three land parts 31 to 33, the land part positioned on the right side is referred to as the first land part 31, the land part positioned on the left side is referred to as the second land part 32, and the land part positioned between the first and second land parts 31, 32 is referred to as the third land part 33, and of the two rod parts 34, 35, the rod part positioned on the right side and which connects the first and third land parts 31, 33 is referred to as the first rod part 34, and the rod part positioned on the left side which connects the second and third land parts 32, 33 is referred to as the second rod part 35. The spool 30 is established inside the valve bore 20 such that the land parts 31 to 33 are engaged, and therefore a first and second groove 24, 25 are formed to be encompassed by the outer circumferential surface of the first and second rod parts 34, 35, the inner circumferential surface 20*a* of the valve bore 20, and the stepped surfaces.

The internal flow channel 30*a* formed in the main unit 30A is formed as a cylinder with bottom which has an opening 30*e* in the right end surface 30*d*. The first land surface 31 has a plurality of first through-holes 36 formed along the outer circumferential surface, the second rod part 35 as a plurality of second through-holes 37 formed along the outer circumferential surface, and the second through-holes 37 open into the second groove 25 when the spool 30 is housed in the valve bore 20. Furthermore, the first and second through-holes 36, 37 are all connected to the internal flow channel 30*a*, are formed to extend in the radial direction with regards to the internal flow channel 30*a*, and are formed in a cylindrical shape in the outer circumferential surface of the spool 30.

Next, the function of the tandem pump 10 and the valve 50 will be described while referring to FIG. 4 through FIG. 6. When the engine is stopped, the tandem pump 10 is stopped, and the spool 30 receives a biasing force from the return spring 40 and is in the initial position. In this initial position, the internal flow channel 30*a* is connected to the recessed part 20*c* through the opening 30*e*. Furthermore, the first port 21 has a first through-hole 36 and the second port 22 is connected to the second groove 25. Therefore, the first port 21 is connected to the second port 22 through the first through-holes 36, the internal flow channel 30*a*, the second through-holes 37, and the second groove 35. On the other hand, the third port 23 is cut off from the first and second ports 21, 22.

When the engine starts, the gears 11 to 13 will be made to rotate, and pumping action will be performed by both oil pumps 16, 17. In other words, the main oil pump 16 will draw in oil which has accumulated in the tank 61 from the main intake opening 16*a* which has been guided through the main oil intake channel 3, and will discharge the oil to the main discharge opening 16*b*. The auxiliary oil pump 17 will draw in the oil, which has been guided from inside the main oil intake channel 3 through the auxiliary oil intake channel 4, from the auxiliary intake opening 17*a*, and will discharge the oil to the auxiliary discharge opening 17*b*. When the spool 30 is in the initial position, the oil is discharged from the auxiliary discharge opening 17*b*, flows into the first port 21 through the upstream section 6*a* of the auxiliary oil supply channel 6, and the entire quantity flows into the internal flow channel 30*a*. The oil which flows into the internal flow channel 30*a* is discharged from the second port 22 and is introduced into the main oil supply channel 5. Therefore, the oil discharged from the main oil pump 16 and the oil discharged from the auxiliary pump 17 will be merged together and will be sent from the main oil supply channel 5 to the oil gallery 62.

The oil gallery 62 which is the destination of the discharged oil is formed inside the casing of the engine, and is constructed such that the supply pressure rises as the amount of oil supplied increases. Therefore, when the rotational speed of the pump (rotational speed of the drive shaft 11*a*) is low such as immediately after the engine starts, the discharge flow rate from both oil pumps 16, 17 will be low, and the oil pressure in both oil supply channels 5, 6 will also be low. However, the oil discharged from both oil pumps 16, 17 is combined and supplied to the oil gallery 62, and therefore when looking at the tandem pump 10 overall, the amount of supplied oil necessary for lubrication will still be discharged.

Furthermore, the oil which flows into the internal flow channel 30*a* will flow through the opening 30*e* and into the recessed region 20*c*. Therefore, the right end surface 30*d* of the spool 30 will be acted on by the oil pressure of the oil in the internal flow channel 30*a* and will be pushed to the left against the biasing force of the return spring force. The spool 30 will compress the return spring 40 by moving to the left, and will move to a position where the pushing force created by the oil pressure is balanced with the biasing force of the return spring 40.

Note, the diameter of the first through-holes 36 and the axial length of the first port 21 are nearly equal, and when the spool 30 is in the initial position, the entire area of the openings of the first through-holes 36 are facing the first port 21. As the spool 30 moves, the first through-holes 36 will move to the left relative to the first port 21, and the area of that portion of the first through-holes 36 which face the first port 21 will gradually be reduced. Therefore, the area of the first through-holes 36 which are open to the first port 21 will become smaller, and the oil channel will be constricted from the first port 21 to the second port 22, and the farther the spool 30 moves towards the left from the initial position, the area of the opening will decrease and the amount of constriction will increase. Therefore the valve 50 of this embodiment has a constricting structure which changes the degree of constriction depending on the degree of oil pressure supplied, and because of this constricting structure, although the discharge flow rate increases for the tandem pump 10 as a whole as the rotational speed of the pump increases, the tendency thereof can be relaxed.

Figure 4:
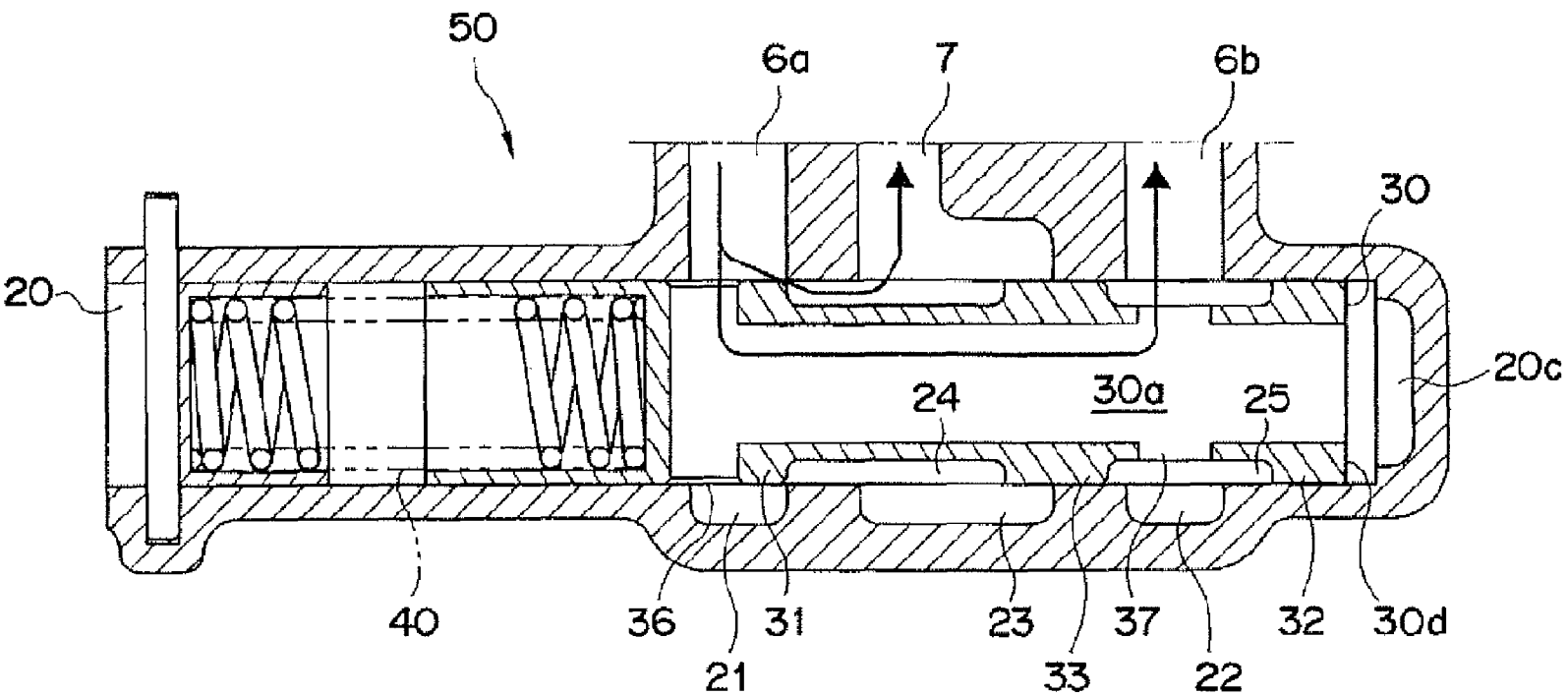
FIG. 4 is a cross-section view of the tandem pump showing the condition where the oil pressure in the main fluid supply channel is at the no-load operation start pressure.

Furthermore, as shown in FIG. 4, when the pump rotational speed further increases and the oil pressure in the main oil supply channel 5 increases to reach the no-load operation start pressure, the right end of the first land part 31 (left end of first rod part 34) will be located at the right end of the first port 21. Therefore, the first groove 24 will begin to connect with the first port 21, a part of the openings of the first through-holes 36 will face the first port 21, and the first and second ports 21, 22 will be maintained in a connected condition as described above.

When the oil pressure in the main oil supply channel 5 exceeds the one load operating start pressure, the axial length of the region where the first groove 24 is connected to the first port 21 will increase. Thus, the first port 21 will be connected to the third port 23 through the first groove 24 by being connected to the first groove 24. Therefore, when the no-load operating start pressure is exceeded, a portion of the oil which flows into the first port 21 will recirculate to the auxiliary intake opening 17*a* through the return flow channel 7. In this manner, the load on the auxiliary oil pump 17 is eliminated and the oil pressure in the upstream section 6*a* of the auxiliary oil supply channel 6 will drop because the oil is recirculated to the auxiliary intake opening 17*a*.

Figure 5:
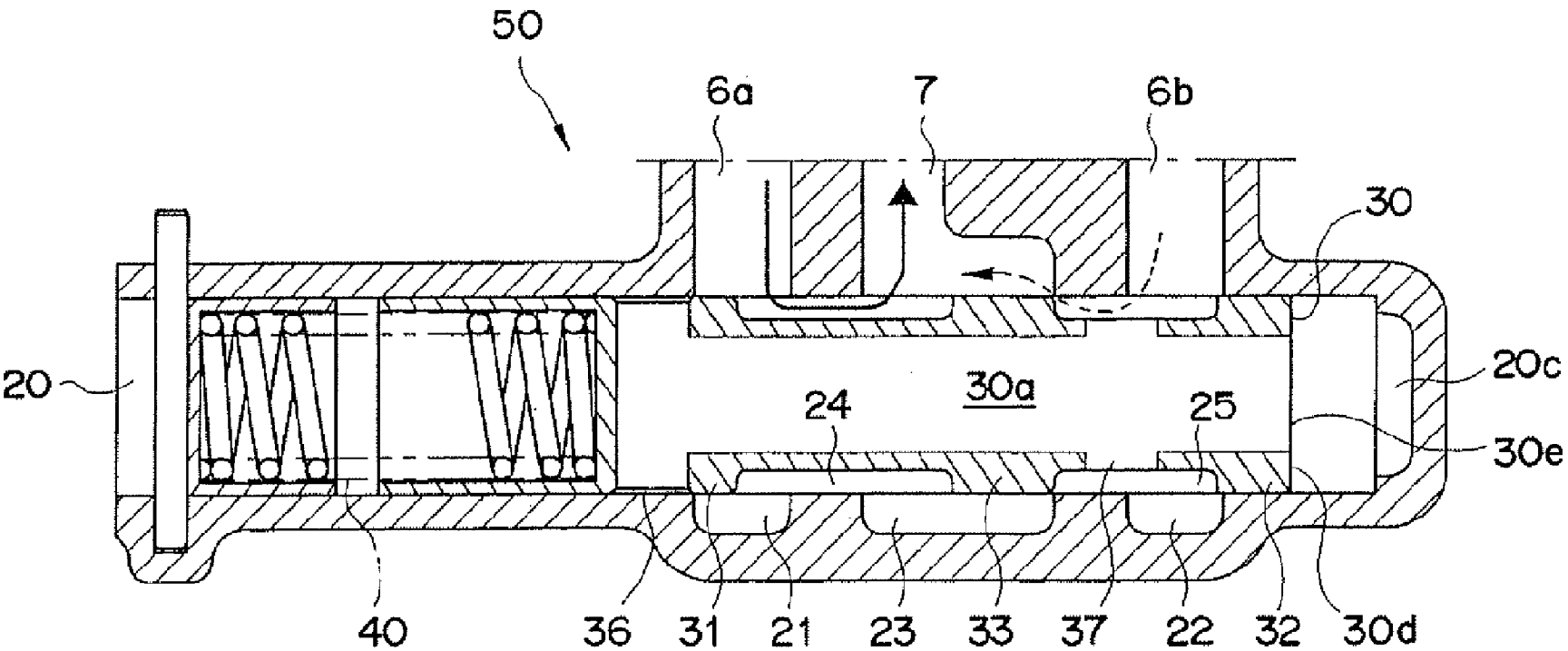
FIG. 5 is a cross section diagram of a tandem pump showing the condition where the oil pressure in the main fluid supply channel is at the no-load operation pressure.

As shown in FIG. 5, when the oil pressure in the main oil supply channel 5 further rises above the no-load operation start pressure, the first through-holes 36 will move to the left of the first port 21 and the entire opening will face the inner circumferential surface 20*a* of the valve bore 20. Thereby, the first port 21 will be cut off from the internal flow channel 30*a*, and will be connected to the third port 23 through the second groove 24. Therefore, the total quantity of oil which is discharged to the auxiliary discharge opening 17*b* and flows into the first port 21 will be recirculated to the auxiliary intake opening 17*a* and the auxiliary oil pump 17 will be in a no-load condition.

Furthermore, as shown in FIG. 5, immediately prior to the oil pressure in the main oil supply channel 5 reaching the no-load operation pressure and the first port 21 being completely cut off from the internal flow channel 30*a*, the left end of the second groove 25 will be positioned at the right end of the third port 23, and the second groove 25 will begin to be connected to the third port 23. Thereby the oil discharged from the main oil pump 16 will begin to be relieved. In other words, a high pressure relief cracking pressure will be established immediately prior to the no-load operation pressure.

Figure 6:
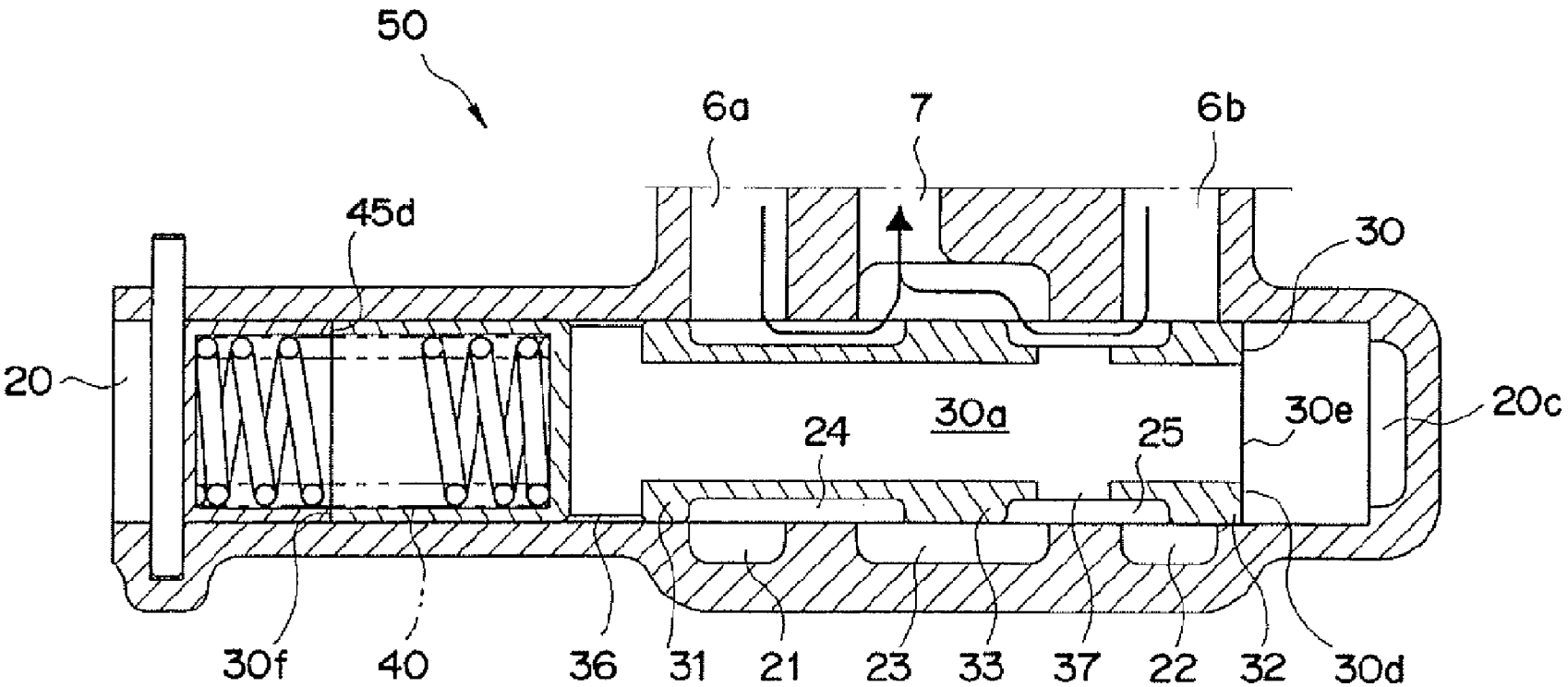
FIG. 6 is a cross section diagram of a tandem pump showing the condition where the oil pressure in the main fluid supply channel is at the relief set pressure.

FIG. 6 shows the condition where the oil pressure in the main oil supply channel 5 rises above the cracking pressure to reach the relief set pressure and the spool 30 is in the maximum left travel position. At this time, the first port 21 is connected only to the third port 23 and is in a no-load operation condition. Furthermore, the second port 22 is connected to the third port 23 through the second groove 25, and the second groove 25 is connected to the internal flow channel 30*a* through the second through-holes 37. Therefore the oil pressure in the main oil supply channel 5 will be held to the relief set pressure because the second port 22 is connected to the third port 23. Furthermore, the second part 37 is always connected to the internal flow channel 30*a*, regardless of the position of travel of the spool 30, and therefore even though the auxiliary oil pump 17 is in the no-load operation condition, oil pressure to push the spool 30 against the biasing force will be supplied to the internal flow channel 30*a*.

Furthermore, when the engine rotational speed decreases after the spool 30 is in the maximum left travel position, the rotational speed of the pump will drop and the oil pressure in the main oil supply channel 5 will drop, and the spool 30 will move to the right. As the spool 30 moves to the right, the function of the high pressure relief will end and the no-load operation condition will be over.

In this manner, using a simple structure consisting of a spool 30 and a return spring 40, the valve 50 of the present embodiment can function both as a no-load valve to place the auxiliary oil pump 17 of a tandem pump 10 in a no-load operation condition, and also function as a relief valve to adjust the discharge oil pressure from the main oil pump 16, and can also make the size of the overall tandem pump 10 more compact. The no-load valve function works to reduce the loss of engine output to the drive source by reducing the excess supply of oil, and the relief valve function can prevent pressures which exceed the relief set pressure from acting on the oil gallery 62 side and can ensure the safety of the oil pressure system on the oil gallery 62 side.

Furthermore, when the spool 30 moves from the initial position to the position where all of the opening of the first through-holes 36 are facing the inner circumferential surface 20*a* of the valve bore 20, the oil discharged from the auxiliary oil pump 17 will be merged with the oil discharged from the main oil pump 16, but will be constricted based on the oil pressure in the main oil supply channel 5. The effect of this constriction gradually reduces the ratio of the oil discharged from the auxiliary oil pump 17 with regards to the total supplied oil, and although the overall amount of oil discharged from the tandem pump 10 increases as the rotational speed of the pump increases, this tendency is relaxed. Furthermore, the structure which creates this constricting effect is a very simple structure and can change the degree of constriction of the internal flow channel 30*a* and the upstream section 6*a* of the auxiliary oil supply channel 6 by changing the area with regards to the first port 21 of the openings of the first through-holes 36 which are formed in the spool 30.

Furthermore, when the oil pressure in the main oil supply channel 5 reaches the no-load operation start pressure and rises further, the first port 21 is connected to the internal flow channel 30*a* through the first through-holes 36 and is connected with the third port 23, and therefore the oil pressure in the upstream section 6*a* of the auxiliary oil supply channel 6 will drop. At this time, the spool 30 will move to the left from the initial position so the area of the opening of the first through-holes 36 with regards to the first port 21 will be reduced, and the upstream section 6*a* of the auxiliary oil supply channel 6 will be connected to the internal flow channel 30*a* in a more constricted condition than when the spool 30 is in the initial position. Therefore, the oil pressure in the main oil supply channel 5 (internal flow channel 30*a*) will not be strongly affected by the drop in pressure of the upstream sections 6*a* of the auxiliary oil supply channel 6. The valve 50 of the present embodiment can reduce the possibility of chattering, including from the no-load operation start pressure to the no-load operation pressure.

Furthermore, the first through-holes 36 for connecting the first port 21 to the internal flow channel 30*a* were a plurality of holes extending in the radial direction of the spool 30, and when the no-load operation start pressure is exceeded, the first groove 24 for connecting the first port 21 to the third port 23 will be formed as a donut shaped space encompassed by the outer circumferential surface of the first rod part 34 and the inner circumferential surface 20*a* of the valve bore 20. Thus a structure is provided such that when the no-load operation start pressure is exceeded and the spool 30 moves to the left, the volume of the section of the first groove 24 which is connected to the first port 21 will suddenly increase with regards to the amount of change in the region of the first through-holes 36 which are open to the first port 21. Therefore, the pressure in the upstream section 6*a* of the auxiliary oil supply channel 6, which is reduced by the flow into the first groove 24, can be rapidly reduced with less risk of having an effect on the internal flow channel 30*a* side through the first through-holes 36.

Furthermore, as the pressure in the main oil supply channel 5 reaches the no-load operating pressure and rises further the area of the opening of the first port 21 with regards to the internal flow channel 30*a* is gradually reduced, so when the no-load operation start pressure is reached, the first port 21 will be cut off from the internal flow channel 30*a*. Therefore even in the region of the no-load operation pressure where the first port 21 and the internal flow channel 30*a* open and close, the total amount of oil discharged from the tandem pump 10 will not be largely affected and the changes in the supplied oil pressure associated with the conventional design will not readily occur. Therefore, by using the valve 50 of this embodiment, the risk of chattering can be reduced even under these conditions.

Similarly, the structure where the first port 21 and the internal flow channel 30*a* are cut off in order to create the no-load operation condition (in other words, the structure with a check valve function) shunts the first through-holes 36 formed in the spool 30 in the axial direction with regards to the first port 21, and therefore a structure similar to a conventional structure where the internal flow channel 30*a* is closed using a separate member such as a tappet can be avoided. Therefore, the structure will be simple, and even if the spool 30 moves back and forth in the axial direction, there is no risk of creating abnormal noises.

Furthermore, the relief start pressure is set to a slightly lower pressure than the no-load operation pressure, and therefore the second port 22 in the third port 23 will already start to be connected while the entire opening of the first through-holes are facing the internal circumferential surface 20*a* of the valve bore 20 and the first port 21 is completely cut off from the internal flow channel 30*a*, and some of the oil which has flowed from the main oil supply channel 5 into the downstream section 6*b* of the auxiliary oil supply channel 6 will be discharged to the return flow channel 7. Therefore, from the relief start pressure until the relief set pressure, the pressure change in the internal flow channel 30*a* can be minimized compared to the form where relief begins while the first port 21 is completely cut off from the internal flow channel 30*a*. Thus, with the valve 50 of the present embodiment, chattering can be suppressed even after the start of oil pressure relief in the main oil supply channel 5.

A preferred embodiment of the present invention has been described above, but the scope of the present invention is not restricted to the aforementioned embodiment. The second through-holes 37 may be formed in the thud land part 33 so long as the structure allows the second port 22 to always be connected to the internal flow channel 30*a*. The aforementioned no-load operation start pressure, no-load operation pressure, and relief pressure can easily be changed by changing the axial length of the land parts 31 to 33 or the rod parts 34, 35 or by changing the spring characteristics of the return spring 40. Furthermore, a plate member of prescribed thickness may be placed between the outer side bottom surface of the retainer 45 and the locking pin 49. Thereby the initial displacement of the return spring 40 can easily be set.

Note, an example where the tandem pump is an oil pump on an automotive engine for pumping oil for lubrication to an oil gallery has been shown, but this is not a restriction and the present invention may be used for other applications with other devices, and furthermore, the discharge fluid is not restricted to oil and instead may be water or air. Furthermore, the tandem pump was made from gear pumps, but may also be made from other types of pumps such as a vane pump.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This application claims the priority of Japanese Patent Application No. 2006-221582 filed on Aug. 15, 2006, which is incorporated herein by reference.

What is claimed is:

1. A tandem pump valve structure, comprising:

a tandem pump having a main fluid pump and an auxiliary fluid pump which are simultaneously driven by a drive source;

a main fluid supply channel which extends from a discharge opening of the main fluid pump to a fluid supply subject;

an auxiliary fluid supply channel extending from a discharge opening of the auxiliary fluid pump and connecting to the main fluid supply channel;

a spool which has an internal flow channel extending in an axial direction of the spool and which is fitted by insertion to be able to move inside a valve bore which forms a part of the auxiliary fluid supply channel;

a biasing member which applies a bias to one side in the axial direction of the spool in the valve bore;

the spool comprises a main unit having the internal flow channel, and a biasing force effector which receives a biasing force from the biasing member and which is connected to the other end of the main unit;

the main unit of the spool comprises a first end land part, middle land part, and second end land part, all of which are cylindrically shaped and separated in the axial direction of the spool, a first end rod part which is formed in a cylindrical shape with a smaller diameter than the middle land part and which links the first end land part and the middle land part, and a second end rod part which is formed in a cylindrical shape with a smaller diameter than the middle land part and which links the middle land part and the second end land part;

the first end land part, middle land part, and second end land part are fitted in the valve bore, one end groove is formed to be encompassed by an outer circumferential surface of the first end rod part and an inner circumferential surface of the valve bore, and a second end groove is formed to be encompassed by an outer circumferential surface of the second end rod part and an inner circumferential surface of the valve bore;

a first end through-hole is formed to pass through the outer circumferential surface and communicate with the internal flow channel at the first land part, and a second end through-hole is formed to pass through the outer circumferential surface and communicate with the internal flow channel at one of either the second end rod part or the second end land part;

the first end through-hole communicates the main fluid channel with the internal flow channel regardless of a travel position of the spool;

the second end through-hole is configured such that an area of the opening to the auxiliary fluid channel changes depending on the travel position of the spool; and a return flow channel which is connected to the valve bore, wherein the spool receives pressure from the main fluid supply channel and is able to move in the axial direction toward a second end side of the spool, counteracting the biasing force of the biasing member, the auxiliary fluid supply channel is communicated with the main fluid supply channel through the internal flow channel when the pressure in the main fluid supply channel is lower than a no-load operation start pressure, the spool is moved against the biasing force of the biasing member and an opening area of the auxiliary fluid supply channel becomes smaller with regards to the internal flow channel when the pressure in the main fluid supply channel rises, the auxiliary fluid supply channel is connected to the return flow channel, with the auxiliary fluid supply channel which has a reduced opening area with regards to the internal flow channel being communicated with the main fluid supply channel, when the pressure in the main fluid supply channel rises to the no-load operation start pressure, and the auxiliary fluid supply channel is cut off from the main fluid supply channel when the pressure in the main fluid supply channel rises above the no-load operation start pressure to reach a no-load operation pressure.

2. The tandem pump valve structure according to claim 1, wherein when the pressure in the main fluid supply channel reaches a relief set pressure which is higher than the no-load operation pressure, the spool further moves against the biasing force of the biasing member, and the auxiliary fluid supply channel and the main fluid supply channel are communicated with the return flow channel.

3. The tandem pump valve structure according to claim 1, wherein the tandem pump comprises a drive gear which is driven by the drive source, and a gear pump comprising a first driven gear and a second driven gear which externally mesh with the drive gear.

4. The tandem pump valve structure according to claim 1, wherein the return flow channel is connected to an intake opening of the auxiliary fluid pump.

* * * * *